US010369397B2

(12) United States Patent
Allen

(10) Patent No.: US 10,369,397 B2
(45) Date of Patent: Aug. 6, 2019

(54) JUMPING ASSISTANCE SYSTEM AND METHOD

(71) Applicant: Damien Allen, Guelph (CA)

(72) Inventor: Damien Allen, Guelph (CA)

( * ) Notice: Subject to any disclaimer, the term of this patent is extended or adjusted under 35 U.S.C. 154(b) by 122 days.

(21) Appl. No.: 15/440,337

(22) Filed: Feb. 23, 2017

(65) Prior Publication Data

US 2018/0236289 A1 Aug. 23, 2018

(51) Int. Cl.

| | |
|---|---|
| ***A63B 5/16*** | (2006.01) |
| ***A63B 21/068*** | (2006.01) |
| ***A63B 21/055*** | (2006.01) |
| ***A63B 21/00*** | (2006.01) |
| ***A63B 23/12*** | (2006.01) |
| ***A63B 21/04*** | (2006.01) |
| *A63B 21/008* | (2006.01) |
| *A63B 7/00* | (2006.01) |

(52) U.S. Cl.

CPC ..... *A63B 5/16* (2013.01); *A63B 21/00181* (2013.01); *A63B 21/0442* (2013.01); *A63B 21/0552* (2013.01); *A63B 21/068* (2013.01); *A63B 21/154* (2013.01); *A63B 21/4009* (2015.10); *A63B 23/1218* (2013.01); *A63B 7/00* (2013.01); *A63B 21/0085* (2013.01); *A63B 2210/50* (2013.01)

(58) Field of Classification Search

CPC ..... A61H 3/008; A61H 1/0229; A63B 5/16; A63B 21/00181; A63B 21/0442; A63B 21/4009; A63B 21/0552; A63B 21/068; A63B 21/154; A63B 21/0085; A63B 21/00047; A63B 23/1218; A63B 2210/50; A63B 7/00

See application file for complete search history.

(56) References Cited

U.S. PATENT DOCUMENTS

| | | | | |
|---|---|---|---|---|
| 2,928,675 A * | 3/1960 | Nawara | A63B 21/154 482/133 |
| 3,384,332 A * | 5/1968 | Fenner | A63B 7/00 248/163.2 |
| 4,634,118 A * | 1/1987 | Jensen | A63B 21/06 482/133 |
| 5,788,606 A * | 8/1998 | Rich | A63B 69/0064 482/27 |

(Continued)

*Primary Examiner* — Megan Anderson

(74) *Attorney, Agent, or Firm* — Integrity Patent Group, PLC; Charles E. Runyan

(57) ABSTRACT

A jumping assistance system is disclosed herein. The jumping assistance system includes a base frame assembly, a support stand, an upper frame assembly, and a training harness that combine to provide a secure support structure from which a user may perform a training or exercise routine that involves repeated jumping movements or pull-ups. The jumping assistance system is useful for suspending a user beneath the upper frame assembly by a set of resistance bands or other secure means that may still allow the user's feet to come in contact with the ground. From this supported position, the user may engage in a series of jumping exercises or extended workout routines while minimizing the impact of repeated jumps to their joints, feet, and other body parts. The jumping assistance system also features a series of hinges that allow the support device to be conveniently folded for storage purposes.

20 Claims, 5 Drawing Sheets

(56) References Cited

U.S. PATENT DOCUMENTS

| | | | | |
|---|---|---|---|---|
| 7,354,382 | B1 * | 4/2008 | Warren, II | A61G 7/1017<br>482/68 |
| 7,722,514 | B2 | 5/2010 | Paine, Jr. | |
| 9,259,603 | B2 * | 2/2016 | Wireman | A63B 5/16 |
| 2010/0000546 | A1 * | 1/2010 | Park | A61H 3/008<br>128/845 |

* cited by examiner

JUMPING ASSISTANCE SYSTEM AND METHOD

BACKGROUND OF THE INVENTION

The following includes information that may be useful in understanding the present disclosure. It is not an admission that any of the information provided herein is prior art nor material to the presently described or claimed inventions, nor that any publication or document that is specifically or implicitly referenced is prior art.

1. Field of the Invention

The present invention relates generally to the field of exercise equipment and more specifically relates to assisted training devices.

2. Description of Related Art

In present day society, many athletes turn to various types of exercise equipment in order to improve physical conditioning and increase strength for fun and competition. Some equipment is small enough to be placed in a room or garage at home, while other types of equipment may require larger spaces that can only be found in a gym or health club. There currently exists a broad range of different types of exercise equipment ranging from dumbbells and weight machines to treadmills and wall bars.

Many exercise machines either focus on one specific muscle group or provide a variety of interchangeable options for an all-around workout. However, some athletes require more specialization in their workouts. For a track athlete, volleyball player, or basketball player it is imperative that they develop their lower extremities so that they may become more explosive in their strides and leaping abilities. To accomplish this type of training, these athletes often must repeat hundreds of repetitions to properly condition their feet, ankles, and legs, which may invariably lead to a premature breakdown of the joints and muscles involved. A suitable solution is desired.

U.S. Pat. No. 7,722,514 to Paine, J R., relates to a multi-directional body swing, turn and twist trainer with interchangeable and adjustable attachments. The described multi-directional body swing, turn and twist trainer with interchangeable and adjustable attachments includes an exercise apparatus for providing multi-directional training to the body of a user is disclosed. The exercise apparatus allows the user to exercise the mid-section, hips, legs, ankles and connective tissues enjoining all the muscles in these areas. The exercise apparatus comprises a main frame, a foot platform (preferably two) and means for attaching the foot platforms to the main frame. The exercise apparatus is designed to be free standing or to be mounted onto other supporting structures. The apparatus has multiple interchangeable parts, attachments and accessories for allowing several types of exercises.

BRIEF SUMMARY OF THE INVENTION

In view of the foregoing disadvantages inherent in the known exercise equipment art, the present disclosure provides a novel jumping assistance system. The general purpose of the present disclosure, which will be described subsequently in greater detail, is to provide an apparatus for aiding a user in jumping exercises and pull-up training.

A jumping assistance system is disclosed herein. The jumping assistance system may include a base frame assembly having a main base support, a pair of base hinges, and a foldable base support. The jumping assistance system may further include a support stand having a back side and an upper frame assembly having an upper frame support, a pair of upper support hinges, a detachable exercise bar, a left upper support arm including a left pulley, and a right upper support arm including a right pulley. The base frame assembly, support stand, and upper frame assembly may be configured to provide a support structure from which exercise routines involving jumping can be executed. In addition, the jumping assistance system may feature a training harness apparatus that is useful for securely suspending a user beneath the upper frame assembly in a manner that allows them to perform repeated jumps.

According to another embodiment, a method of using the jumping assistance system is also disclosed herein. The method of using the jumping assistance system may comprise the steps of securing the harness around the user, connecting the harness to the upper frame assembly via a means of suspension, jumping in position with the aid of the jumping assistance system, and removing the harness from the body of the user.

For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and methods of use for the present disclosure, a jumping assistance system, constructed and operative according to the teachings of the present disclosure.

The various embodiments of the present invention will hereinafter be described in conjunction with the appended drawings, wherein like designations denote like elements.

DETAILED DESCRIPTION

As discussed above, embodiments of the present disclosure relate to exercise equipment and more particularly to a jumping assistance system as used to improve exercise equipment in the field of jumping.

Generally, the invention is a jumping assistance system that may stand alone or hook up to a squat rack and is designed to help athletes jump higher. Athletes may perform repeated jumps or engage in speed training using bands or pneumatics. The device may also be used for gymnastics and ice skating. Preferably, the device is configured to be easily adjustable for athletes of various heights and weights.

The jumping assistance system may use bands or pneumatics which may attach to the user-athlete through a harness. This may allow the athlete to practice jumping at a reduced weight without impeding their arm swing, thus permitting the athlete to move faster than he or she normally could resulting in higher jumps. The use of adjustable resistance bands may also allow for reduced force on landings sparing the athlete's joints during training sessions. The jumping assistance system may also help athletes exercise by providing a strong and sturdy base from which they may perform repeated pull-up repetitions.

Figure 1:
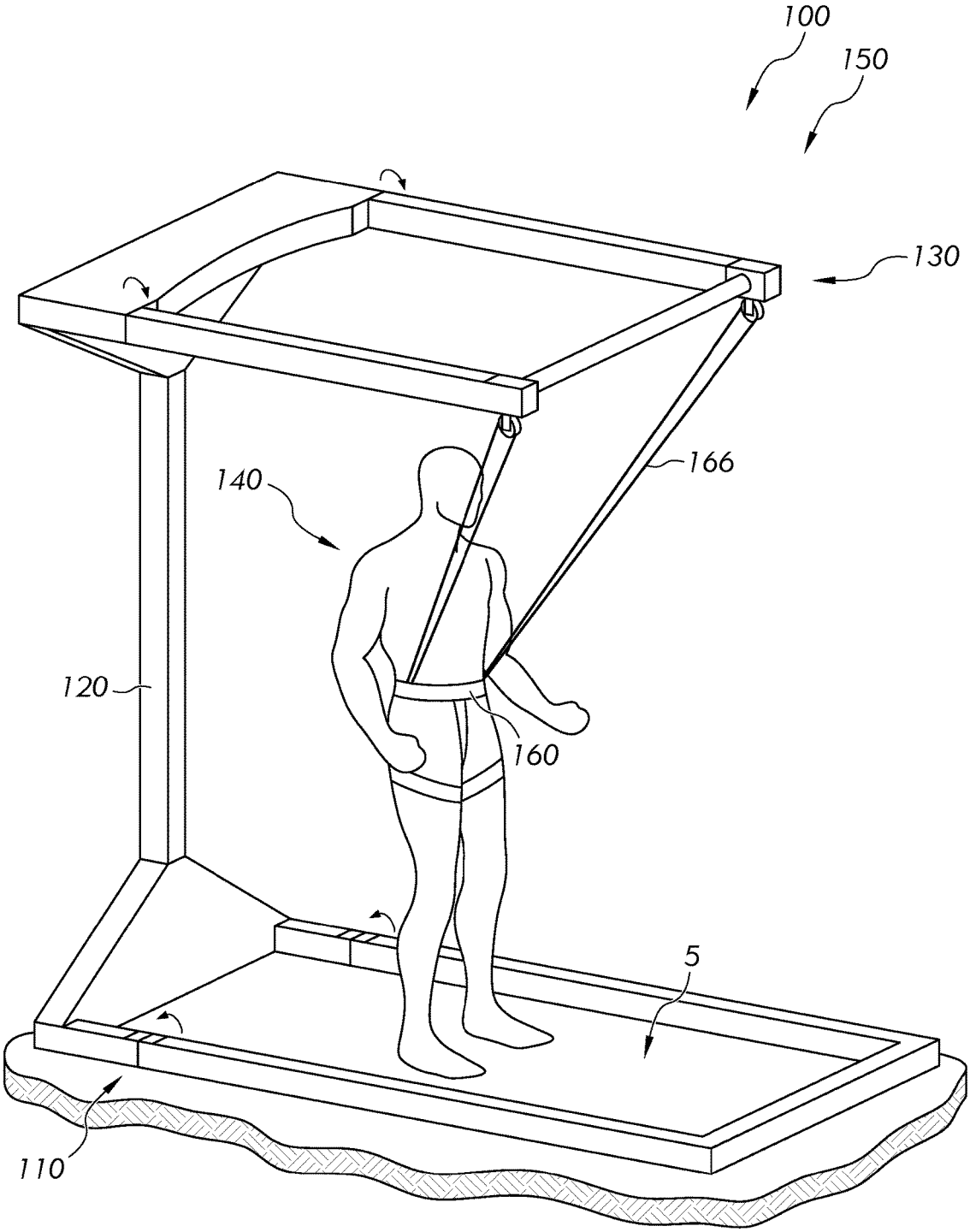
FIG. 1 is a perspective view of the jumping assistance system during an 'in-use' condition, according to an embodiment of the disclosure.

Referring now more specifically to the drawings by numerals of reference, there is shown in FIGS. 1-4, various views of a jumping assistance system 100. FIG. 1 shows a jumping assistance system 100 during an 'in-use' condition 150, according to an embodiment of the present disclosure. Here, the jumping assistance system 100 may be beneficial for use by a user 140 to perform a training or exercise routine that involves repeated jumping movements. As illustrated, the jumping assistance system 100 may include a base frame assembly 110 connected to an upper frame assembly 130 by means of a support stand 120, all of which may be configured to lie flat on a planar surface 5 while fully extended and ready for use. The user 140 may be secured in a training harness apparatus 160 that is designed to suspend the user 140 by a means of suspension 166 that allows them to perform an unobstructed jumping routine or repeated exercises while minimizing physical stress to joints or related muscles.

Figure 2:
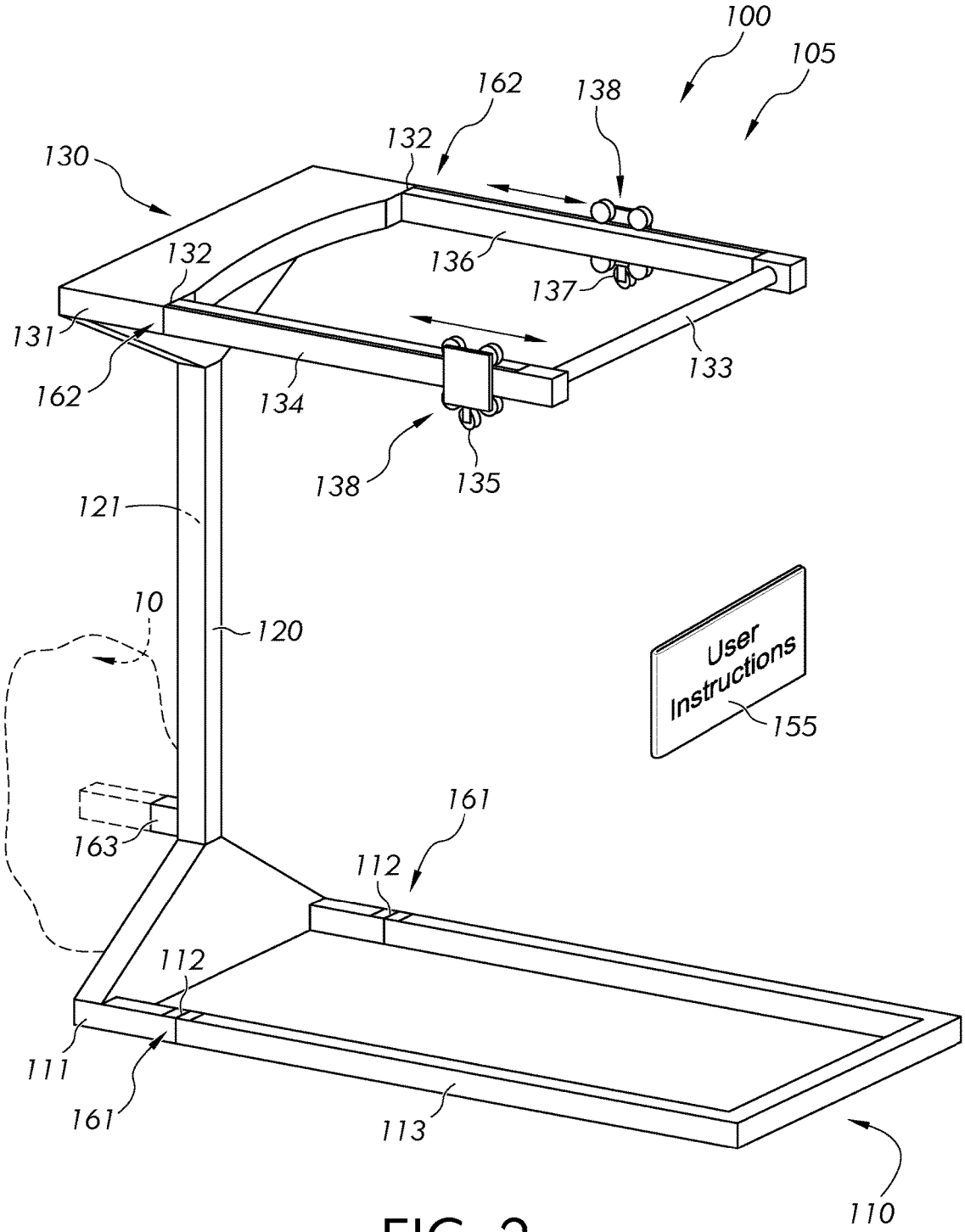
FIG. 2 is a perspective view displaying the base frame assembly, support stand, and upper frame assembly of the jumping assistance system of FIG. 1, according to an embodiment of the present disclosure.

FIG. 2 shows the jumping assistance system 100 of FIG. 1, according to an embodiment of the present disclosure. As above, the jumping assistance system 100 may include a base frame assembly 110 including a main base support 111, a pair of base hinges 112, and a foldable base support 113 that are configured to provide a sturdy base by which the system may be used. The system may further feature a support stand 120 having a back side 121 that extends perpendicularly from the main base support 111 away from the ground to connect with the upper frame assembly 130. The upper frame assembly 130 may include an upper frame support 131, a pair of upper support hinges 132, a detachable exercise bar 133, a left upper support arm 134 including a left pulley 135, and a right upper support arm 136 including a right pulley 137. The left pulley 135 and right pulley 137 may be mounted on a sliding track mechanism 138 further allowing them to adjust slightly based upon preferences. The pair of base hinges 112 and the pair of upper support hinges 132 may feature a base locking mechanism 161 and an upper locking mechanism 162 respectively so that the base frame assembly 110 and the upper frame assembly 130 will be held securely in position while being used. In addition, the support stand 120 may include at least one connecting means 163 so that it may connect to at least one stationary object 10 for redundant support via an external object such as a squat rack which may not be included in the system.

According to one embodiment, the jumping assistance system 100 may be arranged as a kit 105. In particular, the jumping assistance system 100 may further include a set of instructions 155. The instructions 155 may detail functional relationships in relation to the structure of the jumping assistance system 100 (such that the jumping assistance system 100 can be used, maintained, or the like, in a preferred manner).

Figure 3:
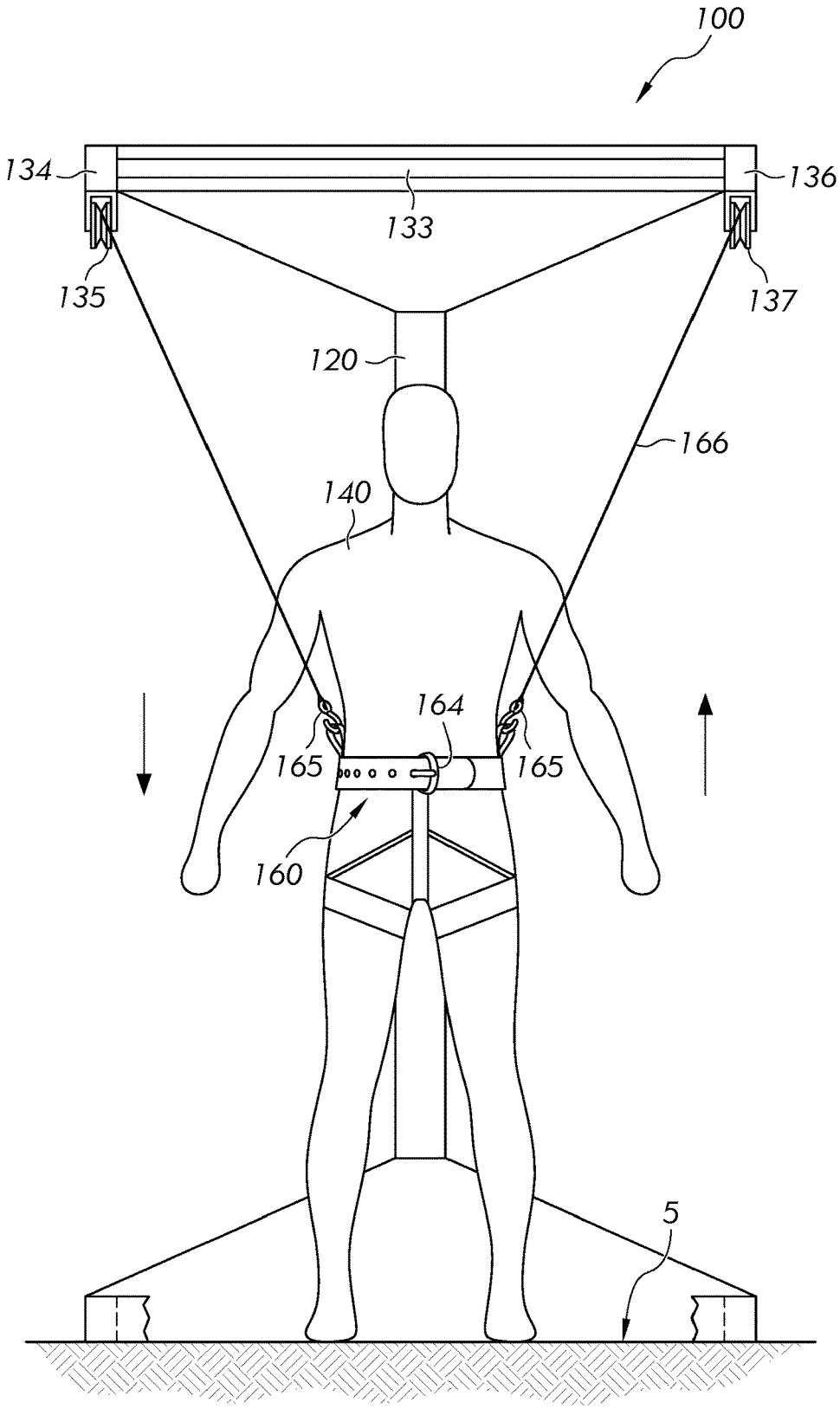
FIG. 3 is a front view illustrating a user preparing to use the jumping assistance system of FIGS. 1-2, according to an embodiment of the present disclosure.

FIG. 3 is a front view of the jumping assistance system 100 of FIG. 1 resting on a planar surface 5, according to an embodiment of the present disclosure. This illustration shows a user 140 secured within the training harness apparatus 160 while being suspended from the left upper support arm 134 and the right upper support arm 136 by a means of suspension 166 which may include a series of ropes, resistance bands, or other pneumatic connectors. The means of suspension 166 may be configured to connect to the left pulley 135 of the left upper support arm 134 and the right pulley 137 of the right upper support arm 136 in such a manner that the user 140 may remain free to move their arms about their torso while performing a jumping exercise routine in position. The training harness apparatus 160 may be coupled to the means of suspension 166 by at least one hook 165 and may further feature a fastener 164 designed to removably retain the user 140.

Figure 4:
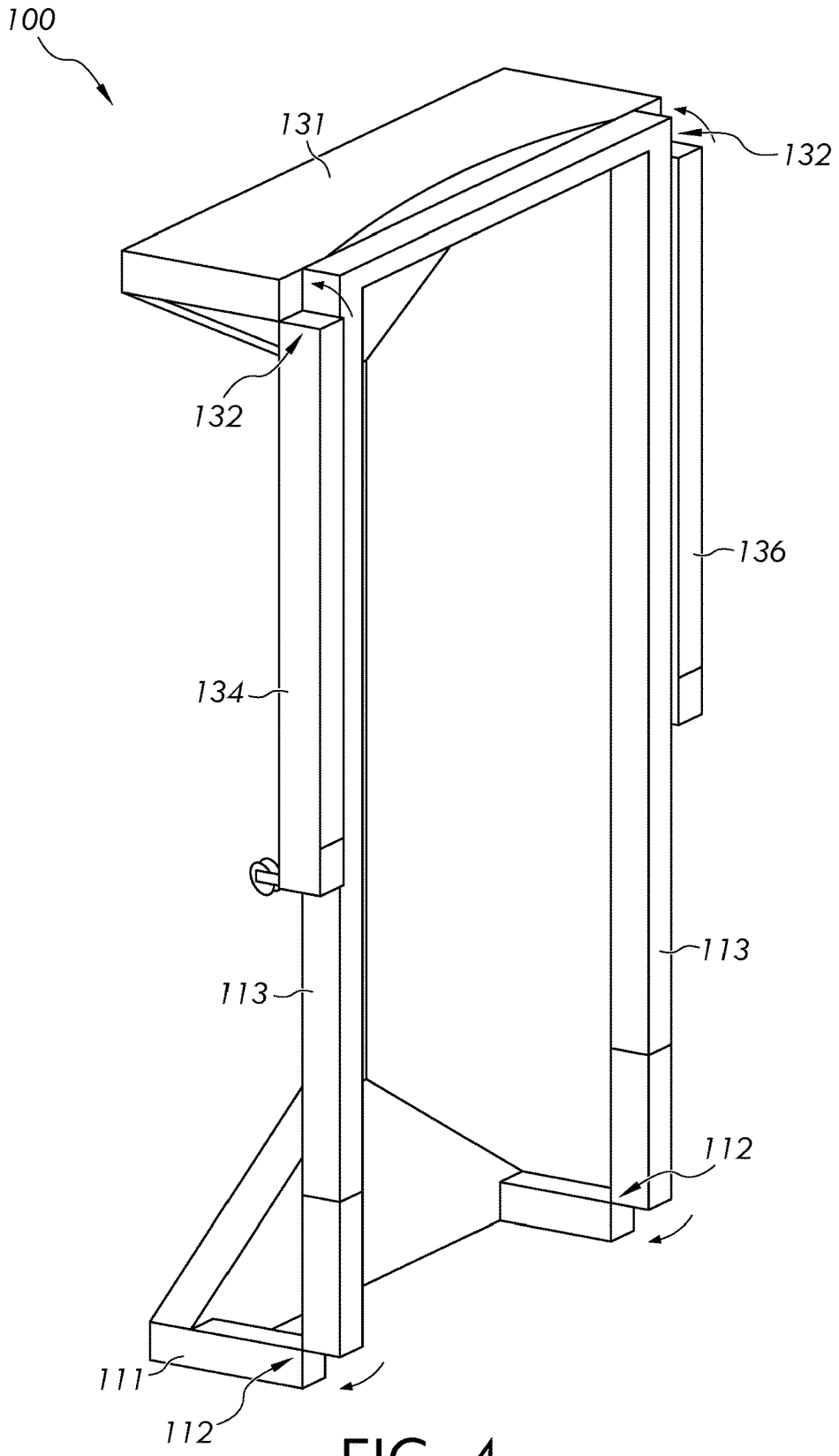
FIG. 4 is a perspective view of the jumping assistance system of FIGS. 1-3, according to an embodiment of the present disclosure displaying the jumping assistance system in a folded up configuration.

FIG. 4 is a perspective view of the jumping assistance system 100 of FIG. 1, according to an embodiment of the present disclosure. This figure shows the jumping assistance system 100 in a folded up configuration with the foldable base support 113, left upper support arm 134, and right upper support arm 136 all folded inwardly to rest in line with each other. The foldable base support 113 may rotate by means of the included base hinges 112 that further couple to the adjoining main base support 111. A similar configuration may be displayed where the upper frame support 131 couples with the upper support hinges 132 that in turn may allow the left upper support arm 134 and right upper support arm 136 to fold in as well.

Figure 5:
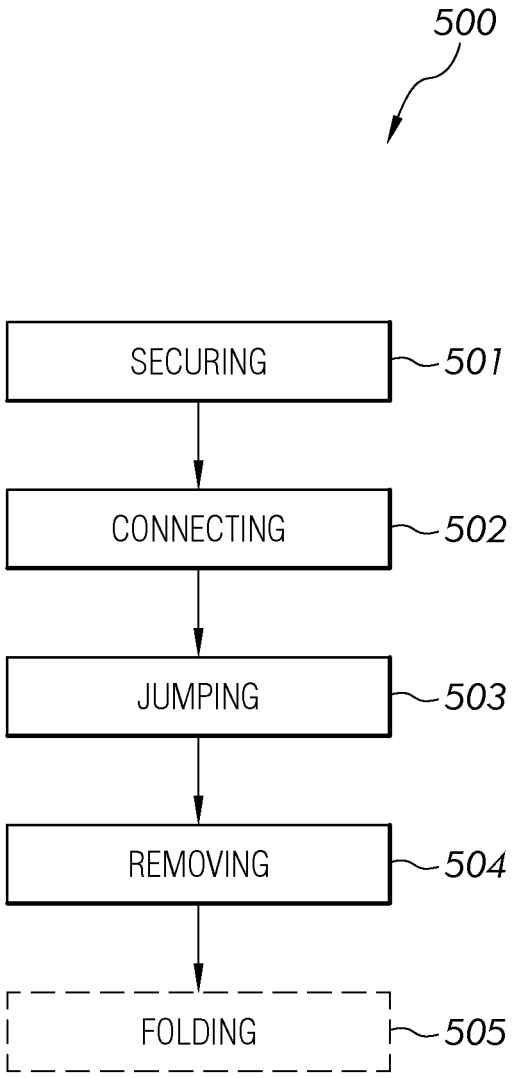
FIG. 5 is a flow diagram illustrating a method of use for the jumping assistance system, according to an embodiment of the present disclosure.

FIG. 5 is a flow diagram illustrating a method of using 500 the jumping assistance system 100, according to an embodiment of the present disclosure. In particular, the method of using 500 may include one or more components or features of the jumping assistance system 100 as described above. As illustrated, the method of using 500 may include the steps of: step one 501, securing the training harness apparatus 160 around the user 140; step two 502, connecting the training harness apparatus 160 to the upper frame assembly 130 via a means of suspension 166; step three 503, jumping in position with the aid of the jumping assistance system 100; and step four 504, removing the training harness apparatus 160 from the body of the user 140.

It should be noted that step five 505 is an optional step and may not be implemented in all cases. Optional steps of method of use 500 are illustrated using dotted lines in FIG. 5 so as to distinguish them from the other steps of method of use 500. It should also be noted that the steps described in the method of use can be carried out in many different orders according to user preference. The use of "step of" should not be interpreted as "step for", in the claims herein and is not intended to invoke the provisions of 35 U.S.C. § 112(f). It should also be noted that, under appropriate circumstances, considering such issues as design preference, user preferences, marketing preferences, cost, structural requirements, available materials, technological advances, etc., other methods for exercise equipment systems (e.g., different step orders within above-mentioned list, elimination or addition of certain steps, including or excluding certain maintenance steps, etc.), are taught herein.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A jumping assistance system having:

a base frame assembly including a main base support, a pair of base hinges, and a foldable base support;

a support stand having a back side;

an upper frame assembly including an upper frame support, a pair of upper support hinges, a detachable exercise bar, a left upper support arm including a left pulley, and a right upper support arm including a right pulley;

and a training harness apparatus;

wherein said main base support is coupled to said foldable base support;

wherein said main base support is configured to lie flat on a planar surface while fully extended;

wherein said main base support is coupled to said support stand in a perpendicular formation;

wherein said upper frame support is coupled to said support stand in a perpendicular formation;

wherein said upper frame support is suspended above and parallel to said main base support;

wherein said left upper support arm and said right upper support arm are coupled to said upper frame support via said pair of upper support hinges;

wherein said left upper support arm and said right upper support arm are configured to be parallel to each other;

wherein said detachable exercise bar is configured to be supported by said left upper support arm and said right upper support arm;

wherein said upper frame assembly including said detachable exercise bar forms a rectangular shape;

wherein said training harness apparatus is configured to hang from said upper frame assembly;

and wherein said jumping assistance system is configured to be used for jumping exercises by a user.

2. The jumping assistance system of claim 1, wherein said foldable base support is U-shaped and connects to said main base support via said pair of base hinges.

3. The jumping assistance system of claim 2, wherein said support stand is rigid.

4. The jumping assistance system of claim 3, wherein said pair of base hinges are configured to rotate said foldable base support at least 90 degrees toward said support stand for purposes of collapsible storage.

5. The jumping assistance system of claim 4, wherein said pair of base hinges includes a base lock for selectably securing said foldable base support.

6. The jumping assistance system of claim 5, wherein said support stand widens near said base frame assembly and said upper frame assembly.

7. The jumping assistance system of claim 6, wherein said left upper support arm and said right upper support arm are configured to retract toward said support stand for the collapsible storage of said jumping assistance system.

8. The jumping assistance system of claim 7, wherein said pair of upper support hinges include an upper lock for selectably securing said left upper support arm and said right upper support arm.

9. The jumping assistance system of claim 1, wherein said left pulley and said right pulley are configured to support a load via said training harness apparatus.

10. The jumping assistance system of claim 9, wherein said left pulley and said right pulley are mounted to a sliding track.

11. The jumping assistance system of claim 1, wherein said back side of said rigid support stand includes at least one connecting means to connect to at least one stationary object for redundant support.

12. The jumping assistance system of claim 11, wherein said stationary object is a squat rack exercise apparatus.

13. The jumping assistance system of claim 1, wherein said training harness apparatus includes at least one hook to removably couple with a means of suspension.

14. The jumping assistance system of claim 13, wherein said means of suspension includes at least one item from the group consisting of ropes, resistance bands, and pneumatic connectors.

15. The jumping assistance system of claim 1, wherein said detachable exercise bar is selectably removable from said upper frame assembly.

16. The jumping assistance system of claim 1, wherein said training harness apparatus comprises a fastener configured to removably retain said user.

17. A jumping assistance system comprising:

a base frame assembly including a main base support, a pair of base hinges, and a foldable base support;

a support stand having a back side;

an upper frame assembly including an upper frame support, a pair of upper support hinges, a detachable exercise bar, a left upper support arm including a left pulley, and a right upper support arm including a right pulley;

a training harness apparatus;

wherein said main base support is coupled to said foldable base support;

wherein said main base support of said base frame assembly is configured to lie flat on a planar surface while fully extended;

wherein said main base support is coupled to said support stand in a perpendicular formation;

wherein said upper frame support is coupled to said support stand in a perpendicular formation;

wherein said upper frame support is suspended above and parallel to said main base support;

wherein said left upper support arm and said right upper support arm are coupled to said upper frame support via said pair of upper support hinges;

wherein said left upper support arm and said right upper support arm are configured to be parallel to each other;

wherein said detachable exercise bar is configured to be supported by said left upper support arm and said right upper support arm;

wherein said upper frame assembly including said detachable exercise bar forms a rectangular shape;

wherein said training harness apparatus is configured to hang from said upper frame assembly;

wherein said jumping assistance system is configured to be used for jumping exercises by a user;

wherein said foldable base support is U-shaped and connects to said main base support via said pair of base hinges;

wherein said support stand is rigid;

wherein said pair of base hinges are configured to rotate said foldable base support at least 90 degrees toward said support stand for purposes of collapsible storage of said jumping assistance system;

wherein said pair of base hinges includes a base lock for selectably securing said foldable base support;

wherein said support stand widens in width near said base frame assembly and said upper frame assembly for providing support to said jumping assistance system;

wherein said left upper support arm and said right upper support arm are configured to retract toward said support stand for the collapsible storage of said jumping assistance system;

wherein said pair of upper support hinges include an upper lock for selectably securing said left upper support arm and said right upper support arm;

wherein said left pulley and said right pulley are configured to support a load via said training harness apparatus;

wherein said left pulley and said right pulley are mounted to a sliding track;

wherein said detachable exercise bar is selectably removable from said upper frame assembly;

wherein said back side of said rigid support stand includes at least one connecting means to connect to at least one stationary object for redundant support;

wherein said training harness apparatus comprises a fastener configured to removably retain said user;

and wherein said training harness apparatus includes at least one hook to removably couple with a means of suspension.

18. A method of using the jumping assistance system of claim 17, the method comprising the steps of:

securing the training harness apparatus around a body of the user;

connecting the training harness apparatus to the upper frame assembly via the means of suspension;

jumping in position with aid of the jumping assistance system;

removing the training harness apparatus from the body of the user.

19. The method of claim 18, further comprising the steps of: folding up the jumping assistance system for the convenient storage.

20. The jumping assistance system of claim 17 comprising a kit including:

said base frame assembly;

said support stand;

said upper frame assembly;

said training harness apparatus; and a set of user installation instructions.

* * * * *